US005540149A

United States Patent [19]

Hoge

[11] Patent Number: 5,540,149

[45] Date of Patent: Jul. 30, 1996

[54] ROTARY PRINTING MACHINES

[75] Inventor: Ross A. Hoge, Pointe Claire, Canada

[73] Assignee: Magnum Manufacturing Limited, Schomberg, Canada

[21] Appl. No.: 141,038

[22] Filed: Oct. 26, 1993

[51] Int. Cl.[6] ..... B41F 31/34; B41L 27/36

[52] U.S. Cl. ..... 101/352

[58] Field of Search ..... 101/181, 182, 101/183, 247, 137–140, 142, 143, 178–180, 352, 207–210, 351, 148

[56] References Cited

U.S. PATENT DOCUMENTS

| | | | |
|---|---|---|---|
| 3,108,536 | 10/1963 | Harrison . | |
| 3,611,924 | 10/1971 | Harrison . | |
| 3,774,537 | 11/1973 | Christoff . | |
| 4,462,311 | 7/1984 | Armelin | 101/143 |
| 4,616,564 | 10/1986 | Faddis et al. . | |
| 4,831,926 | 5/1989 | Bowman et al. | 101/247 X |
| 4,955,299 | 9/1990 | Ohta | 101/182 |
| 5,069,125 | 12/1991 | Schiavi . | |

*Primary Examiner*—J. Reed Fisher
*Attorney, Agent, or Firm*—Ridout & Maybee

[57] ABSTRACT

In a web offset rotary printing machine having a printing tower with upper and lower portions defining a recess between them, and an interchangeable cassette lodged in the recess and supporting at least plate and blanket cylinders, the upper and lower portions are joined by an elevator mechanism so that the upper portion may be raised and lowered relative to the tower portion to accommodate the interchange of cassettes of different heights. A cassette is supported on transverse linear bearings on the lower portion, and helps support the upper portion when the latter is lowered onto it. The linear bearings allow a cassette to be slid in and out from either side of the machine. The cassettes may be of different heights, thus facilitating optimization of the cylinder arrangement in the cassette. A mechanism is described permitting accurate alignment of form rollers with their associated plate cylinder such that skew adjustments may be made to the plate cylinder when plates or cassettes are changed without upsetting individual form roller adjustments.

3 Claims, 7 Drawing Sheets

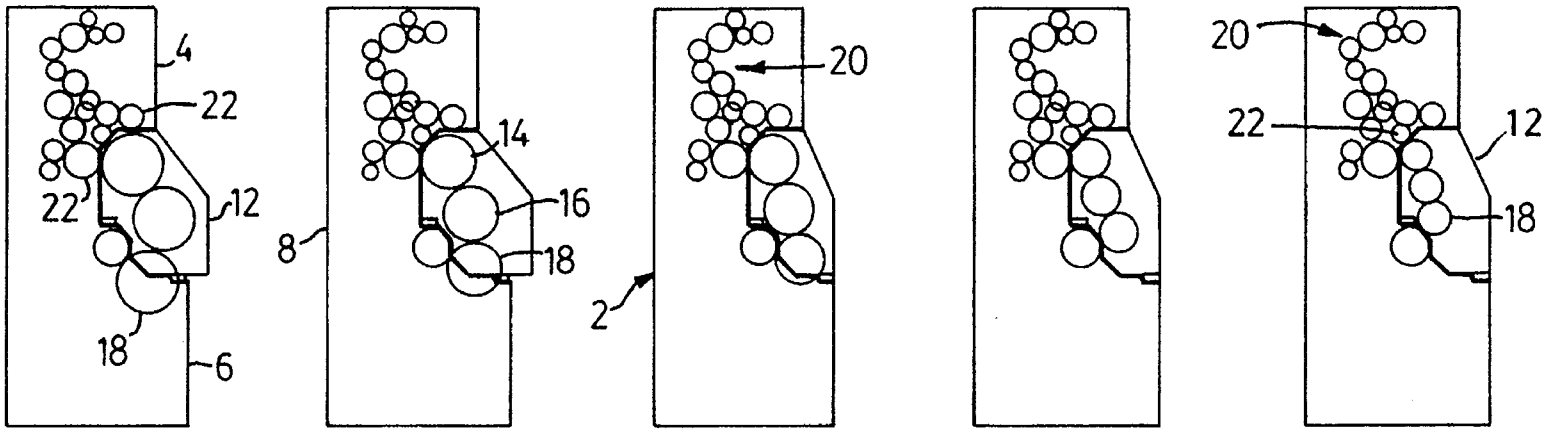
FIG. 1A (PRIOR ART)
FIG. 1B (PRIOR ART)
FIG. 1C (PRIOR ART)
FIG. 1D (PRIOR ART)
FIG. 1E (PRIOR ART)
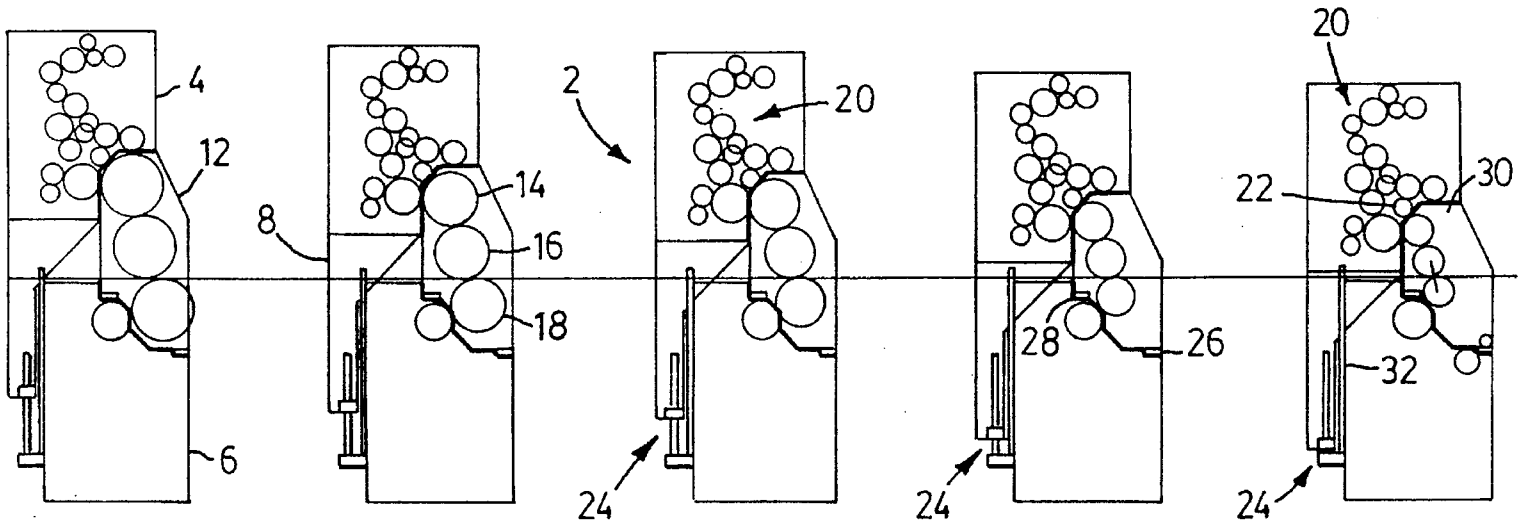
FIG. 2A
FIG. 2B
FIG. 2C
FIG. 2D
FIG. 2E 4
22
14
16
18
6
22
24

12

20
14
16
6
4
2

12
8

4
6
8
24

ROTARY PRINTING MACHINES

BACKGROUND OF THE INVENTION

1. Field of the Invention

This invention relates to rotary printing machines, and more particularly to web offset printing machines of either single sided or perfector (double sided) configurations.

2. Review of the Art

The maximum longitudinal length of an impression or set of impressions which can be produced by a rotary machine is determined by the circumference of the plate cylinder or cylinders, which circumference should however not too greatly exceed the length of the impression. For obvious reasons, the blanket cylinders providing the offset must either be the same diameter as the plate cylinders or an integral multiple of that diameter.

In such a machine the image to be printed is contained on the printing plate which is a thin sheet of material which is treated chemically and photographically to be ink receptive. This plate is wrapped around the plate cylinder and locked into a longitudinal slot. The blanket cylinder is wrapped with a thin piece of elastomeric material which is also locked into a longitudinal slot.

The plate and blanket cylinders are generally overpacked, i.e., the plate and blanket surface diameter exceeds the diameter of the cylinders. This sets up some interference between cylinders while establishing the pressure required to transfer the inked image from the plate cylinder to the blanket cylinder and from the blanket cylinder to the paper web.

A dynamic irregularity is created as the cylinders rotate and the longitudinal slots or gaps pass through the nip, causing printing pressure to be lost. This condition induces the cylinders to vibrate in a flexural or bending mode which interrupts the ink transfer from one cylinder to another. The result is a series of dark and light bands on the printed sheet which are referred to as "streaks".

It can be shown analytically, and is well accepted in the industry, that the "streaking" potential of a printing unit is reduced and that higher printing speeds are obtainable if the printing cylinders are arranged as nearly as possible in a common plane. Many high speed fixed circumference printing machines employ such an in-line cylinder geometry.

To provide flexible operation, it is known to provide printing machines in which at least the plate and blanket cylinders are interchangeable, typically by mounting the cylinders in an interchangeable cassette, which may also include the impression cylinder in the case of a single sided machine. A difficulty encountered with such machines is that, in view of the varying sizes of the cylinders involved, it is impossible to maintain an optimum cylinder geometry over a range of sizes of roll, and with small plate rolls, it may be necessary to resort to double size blanket cylinder. Particularly in a variable circumference perfecting machine it has been impossible to maintain in-line geometry over a wide range of plate cylinder circumferences.

Further difficulties in the design of such machines arise from the necessity of providing for cassette changing, bearing in mind that the rigidity of the machine with the cassette installed is extremely important, particularly for high speed operation. Existing machines have in general configured so that a two-dimensional movement of the cassette is to move it in or out of place, namely a first positioning movement in which it is moved in a direction parallel to the roller axes to position it alongside the machine, followed by a generally horizontal movement in a perpendicular direction to insert it into the structure of the machine and lock it in place. This requirement is wasteful of time, since precise alignment of the cassette is required in two directions. It has been proposed in U.S. Pat. No. 4,616,564 to provide a web offset printing machine of perfecting type in which an upper portion of the printer tower housing the upper inker assembly is hinged, so that it can be raised out of the way to permit a cassette to be lifted out of or lowered into position in the machine. This still requires a two-dimensional movement of the cassette, as well as the use of overhead lifting equipment. Moreover, it does nothing to overcome the other problems associated with accommodating plate cylinders of different diameters in the same machine.

A further problem that arises in machines using interchangeable cassettes is that of maintaining optimum alignment between a plate cylinder in the cassette and inking rollers in the main structure of the machine. It is known in some high quality printing machines to provide means for providing minor adjustment of the skew of the plate cylinder relative to the rubber form rollers that transfer the ink so as to maintain optimum contact between the form rollers and the plate, even when the latter is crooked or poorly installed. Loading applied to the form rollers compresses their rubber and results in a flat between the form rolls and the plate web whereby ink is transferred. For maintaining high quality printing it is critical that this flat is accurately controlled and the skewing of the plate cylinder enables this flat to be maintained at the same width across the plate. Individual adjustments may also be provided on the form rolls so as to maintain the latter accurately parallel to one another. The difficulties of providing and maintaining suitable skew adjustment of the plate cylinder relative to the form rollers are compounded in a machine utilizing interchangeable cassettes, and in consequence, such machines have not generally been regarded as being suitable for high quality printing.

SUMMARY OF THE INVENTION

It is an object of the invention to address the above problems in a web offset printing machine utilizing interchangeable roll cassettes.

I have found that by forming the tower of such a printing machine in two telescopically connected portions, arranged so as to define between them a recess of variable height for housing a cassette, I can provide a solution to most of the above problems. By raising the upper portion of the machine relative to the lower portion, not only can I accommodate cassettes of different heights, thus permitting an in-line cylinder geometry to be maintained over a large range of plate cylinder sizes, but it becomes possible, by raising the upper machine portion somewhat more than is required to accommodate the cassette, to slide the cassette in laterally on linear bearing, and then lower the upper portion of the machine onto it so as to lock the entire assembly rigidly together such that the cassette becomes an integral part of the frame and contributes to its rigidity. This greatly simplifies the exchange of cassettes, and means that force need be applied in one direction only to move the cassette during cassette changing.

I have also developed an improved technique for controlling the skew of plate cylinders relative to form rollers in inkers, which is particularly applicable to printing machines in which the plate cylinders are mounted in cassettes. This is achieved by providing both the form rollers and the plate cylinder engaged thereby with concentric, non-rotating, interengaging tapered disks or part disks, the disk on the plate cylinder having an opposite taper to those on the form rollers, and having an axial position which is adjustable relative to that of the form rollers, thus allowing for simple, conjoint skew adjustment of the plate cylinder relative to plural form rolls.

Further features of the invention will be apparent from the following description of preferred embodiments thereof with reference to the accompanying drawings.

SHORT DESCRIPTION OF THE DRAWINGS

FIGS. 1A to 1E are diagrammatic side elevations of a known form of single sided web offset printing machine utilizing interchangeable cassettes, showing the roll configurations utilized in the main tower of the machine and five different cassettes providing progressively decreasing plate cylinder circumferences;

FIGS. 2A to 2E illustrate diagrammatically a corresponding embodiment of machine in accordance with the present invention, again fitted with cassettes accommodating plate cylinders of the same five circumferences;

DESCRIPTION OF ILLUSTRATED PRIOR ART ARRANGEMENTS

Figures 3A, 3B, 3C, 3D, 3E:
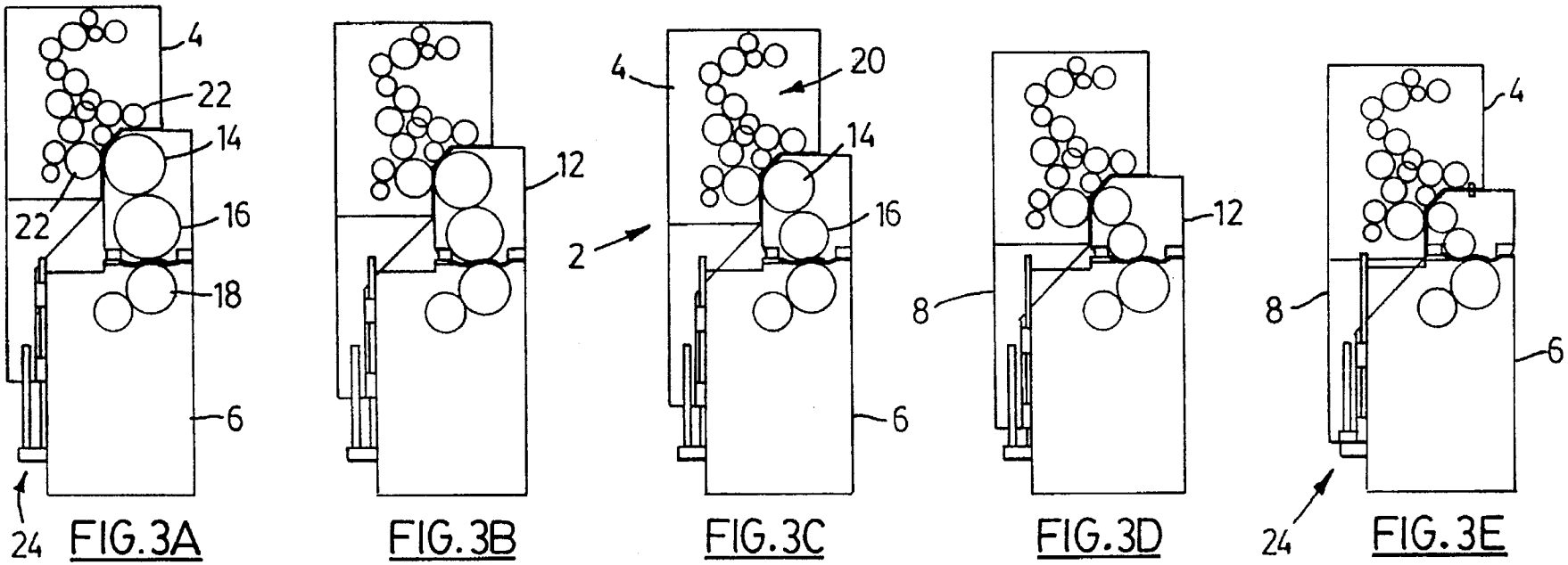
FIGS. 3A to 3E are similar diagrammatical side elevations of a second embodiment of single sided web offset machine according to the invention, in which the impression roller is not incorporated in the cassette, the cassettes again accommodating plate rollers of the same five different circumferences.
Figure 4A:
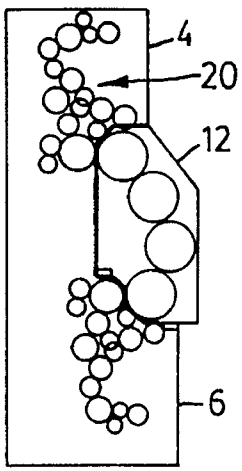
FIG. 4A (PRIOR ART)
FIGS. 4A to 4D are similar diagrammatic side elevations of a prior art perfector or double sided web offset machine, illustrating variations in roll arrangements required to accommodate plate cylinders of four progressively smaller circumferences.
Figure 4B:
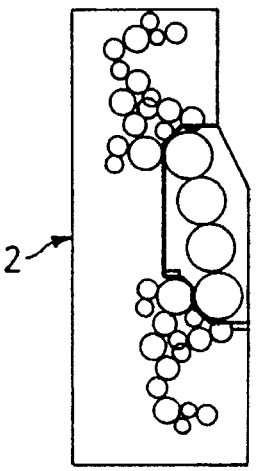
FIG. 4B (PRIOR ART)
Figure 4C:
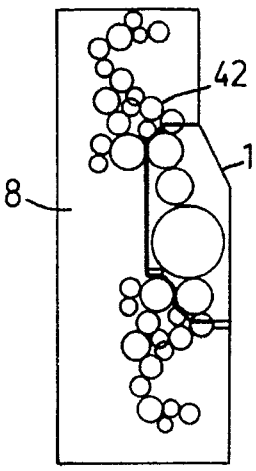
FIG. 4C (PRIOR ART)
Figure 4D:
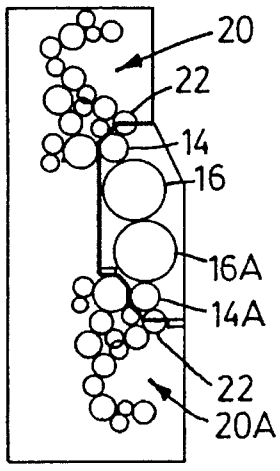
FIG. 4D (PRIOR ART)
Figure 5A:
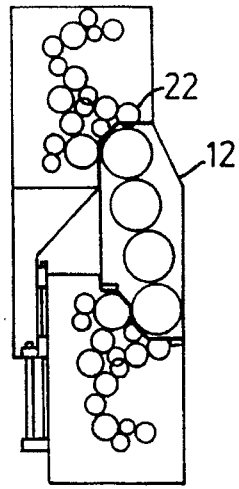
FIGS. 5A to 5D illustrate a machine in accordance with the present invention, again whilst accommodating cassettes utilizing plate and blanket cylinders of the same four circumferences.
Figure 5B:
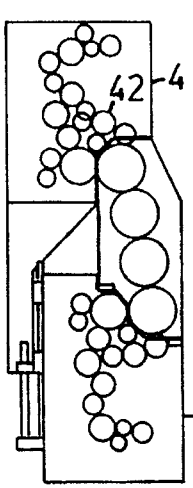
Figure 5C:
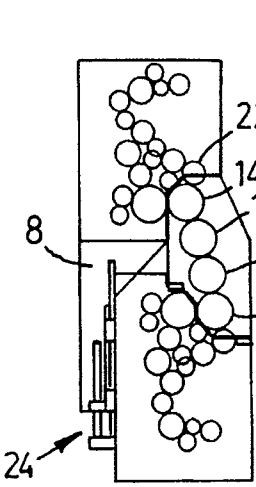
Figure 5D:
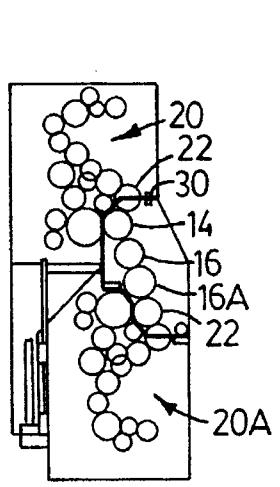

Referring to FIG. 1, a single sided web offset printing machine is shown in side elevation, with end profiles of the various rollers and cylinders employed diagrammatically superimposed. The machine has a printing tower 2 with an upper portion 4 and a lower portion 6 connected by a column 8 so as to define a recess 10 for housing a cassette 12 having connected side walls 44 supporting respectively a plate cylinder 14, a blanket cylinder 16 and an impression cylinder 18, the web path passing between the blanket and impression cylinders. The cassettes shown in FIGS. 1A through 1E employ plate cylinders of successively smaller circumferences, for example 28, 24, 22, 17 and 14 inches. The upper portion of the tower houses an inker 20 incorporating a number of rollers, including form rollers 22.

It will be noted that only with the smaller sizes of plate cylinders is it possible to locate the cylinders with their axes approximately in a common plane, whilst the level of the web, which passes between the blanket and impression cylinders, is different in each case. In the larger sizes, the structure of the machine may prevent the web from taking a straight path through the machine. Furthermore, as the plate cylinder increases in diameter, so does the impression cylinder project further from the cassette structure, thus making the cassette more awkward to install, and preventing it from being installed from one side of the machine.

Referring now to FIG. 4, this shows a conventional machine utilizing interchangeable cassettes and intended for double sided or perfector operation. The same reference numerals are used to indicate parts common to the arrangement previously described, the principal difference being the provision of an additional lower inker 20A in the lower part of the tower, and the provision of additional lower plate and blanket cylinders 14A and 16A, whilst there is no impression cylinder. As before, FIGS. 4A to 4D show the use of cassettes having successively smaller circumference plate cylinders 14.

It will be seen that the different sizes of impression cylinders not only make it difficult to obtain consistently a satisfactory orientation of the various cylinders, but also necessitate that in some cases one or both blanket cylinders be of double circumference.

DESCRIPTION OF THE PREFERRED EMBODIMENTS

Referring to the remaining Figures of the drawings, the same reference numerals as were used in describing the prior art arrangements will be used where applicable to identify corresponding parts.

Referring first to FIG. 2, the column 8 is modified as compared with FIG. 1 by the incorporation of an elevator mechanism 24 connecting the column to the lower portion 6 of the tower 2, thus providing the tower with a telescoping capability such that its upper portion 4 may be raised and lowered relative to the lower portion. The elevator arrangement 24 will be described further below with reference to FIGS. 6 and 7. It should be understood however that the exact form of the elevator mechanism is not important provided that it provides adequate support and accurate guidance of the upper portion 4 of the tower during raising and lowering while a cassette is being changed, at which time it provides the sole support for the upper portion.

Because the upper portion 4 of the tower containing the inker 20 can be raised or lowered, the recess 10 is capable of accommodating cassettes 12 of different heights, as shown in FIGS. 2A to 2G. It will also be noted that the ability to use cassettes of different heights means that the cylinders in the cassette can be optimally aligned, and at the same time the web path through the machine can readily be maintained at the same height despite changes in circumference of the plate cylinder over the same range as in the prior art. Furthermore, there is no projection of the impression cylinder from the cassette such as would obstruct its being rolled into the recess 10 latterly from one side of the machine on linear bearings 26 and 28. During insertion of the cassette, the upper portion 4 of the tower may be raised to provide clearance, and thereafter lowered so that mating portions of pin locks 30 (see FIG. 2E) engage the top of the cassette. In conjunction with the linear bearings 26 and 28, the pin locks 30 provides a three point engagement with side walls of the cassette which rigidly locates the cassette in position in the machine so that it cooperates with the tower structure to form a rigid, integral structure. Thus during operation, the cassette is supported on the lower portion by the linear bearings, and the upper portion is supported on the cassette as well as the elevator mechanism.

FIGS. 3A to 3E illustrate a modification of the machine shown in FIGS. 2A to 2E, in which a fixed impression cylinder 18 is located in the lower portion 6 of the tower, and in consequence, no impression cylinder is incorporated in the cassette 12. Since the impression cylinder is fixed, the web path through the machine remains constant throughout the range of plate cylinder circumferences.

The embodiment of FIGS. 5A to 5D differs from that of FIGS. 2A to 2E in that it shows the invention applied to a double sided or perfector type machine. The differences between this machine and that of FIGS. 2A to 2E are essentially the same as the differences between the machine of FIGS. 4A to 4D and the machine of FIGS. 1A to 1E. As compared with the prior art machine of FIGS. 4A to 4D, it will be noted that the axes of the cylinders in the cassette may be located with their axes substantially in a common plane, which is approximately the same for each cassette, and that in each case the cylinders may all be of the same diameter. There is some variation in this case in the height of the web path, but again there is no projection of the cylinders from the cassette which would obstruct lateral insertion along the linear bearings 26, 28.

Figure 6:
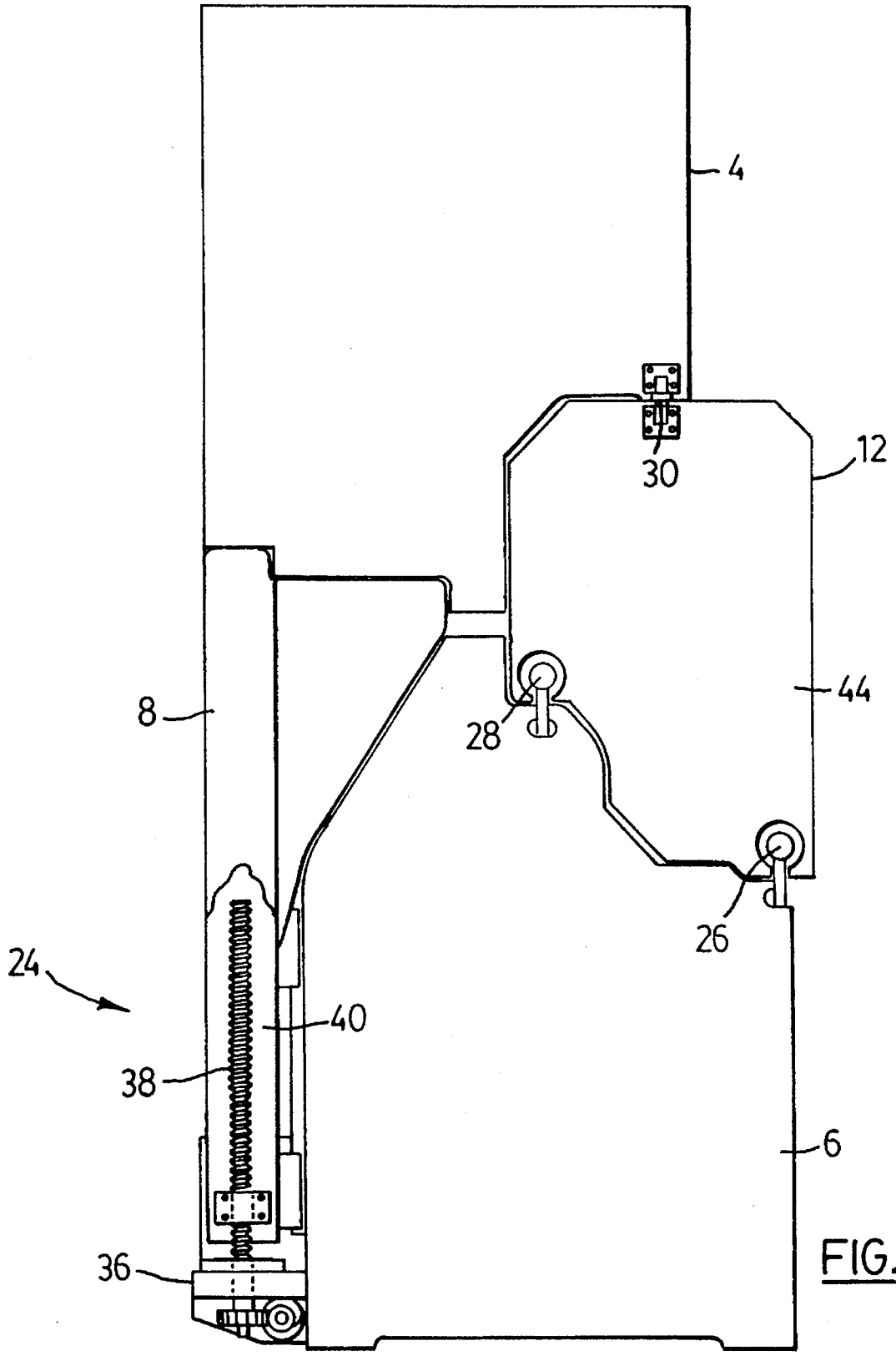
FIGS. 6 and 7 are more detailed side elevations of a machine in accordance with either FIG. 2 or FIG. 5, respectively with the upper portion of the printing tower lowered and a cassette present, and with the upper portion of the printing tower raised and the cassette removed.
Figure 7:
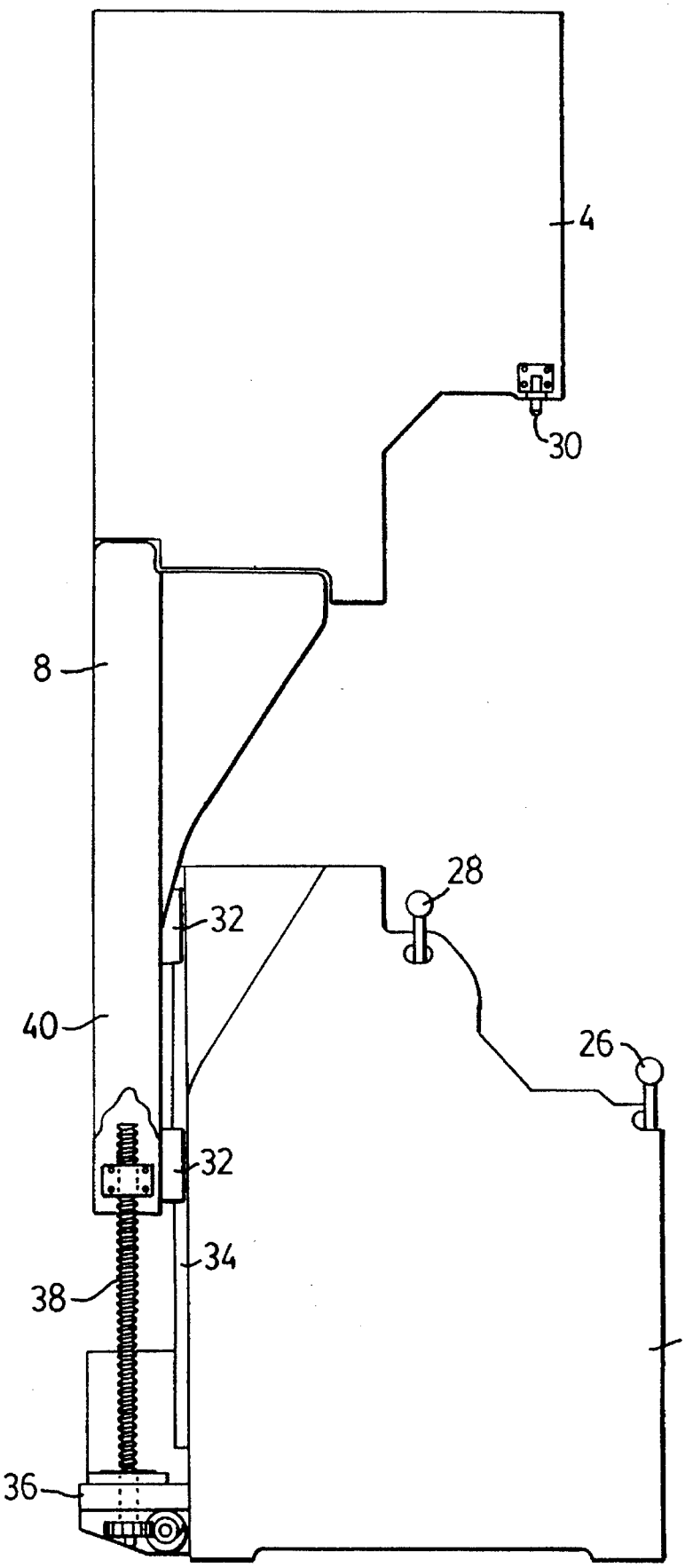

FIGS. 6 and 7 show additional details of the elevator mechanism 24, the linear bearings 26 and 28 and the pin locks 30. The elevator 24 consists of linear bearings 32 engaging guides 34 on the lower portion 6, and a jacking mechanism 36 which rotates a jacking screw 38 within an extension 40 of the column 8 so as to raise or lower the latter on demand. The cassette 12 may be of conventional construction, with the cylinders it includes supported on shafts extending between studs in rigid interconnected side walls.

For ease in illustration, the form rollers 22 are shown in the same position in the various Figures so far described, whereas in fact these rubber covered rollers are urged into contact with the circumference of the plate cylinder 14 as shown in FIG. 6, which shows how the form rollers may be moved about the centre of position rollers 42 to accommodate themselves to plate cylinders of different diameters. For high quality printing, it is important that this accommodation to different sizes of plate cylinders, and to different plates mounted on the same plate cylinder, be achieved whilst maintaining accurately controlled flats between the rubber form rollers and the plate; this is critically necessary if the even ink transfer required for high quality printing is to be achieved.

Figure 8:
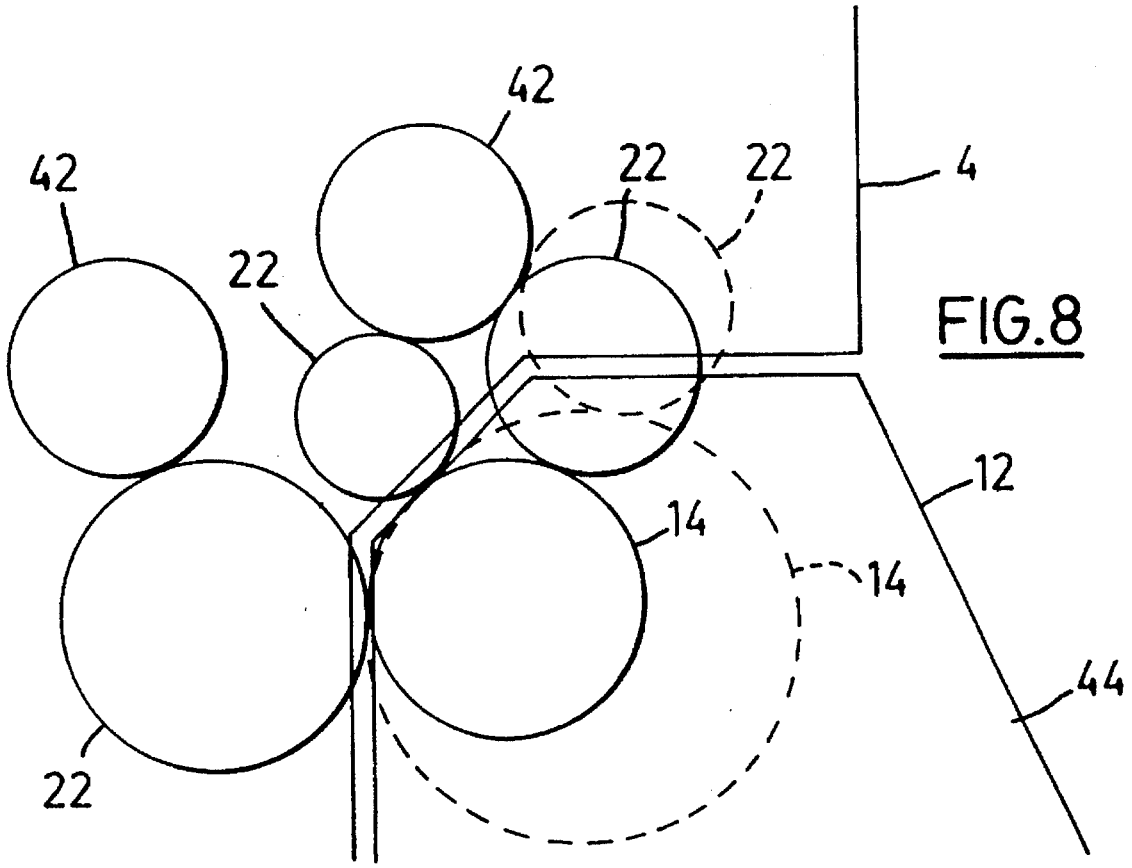
FIG. 8 is an enlarged detail corresponding to FIGS. 2A to 2E or 5A to 5D, illustrating the interaction of form rollers in the upper portion of the printing tower with a plate cylinder in the cassette.
Figure 9:
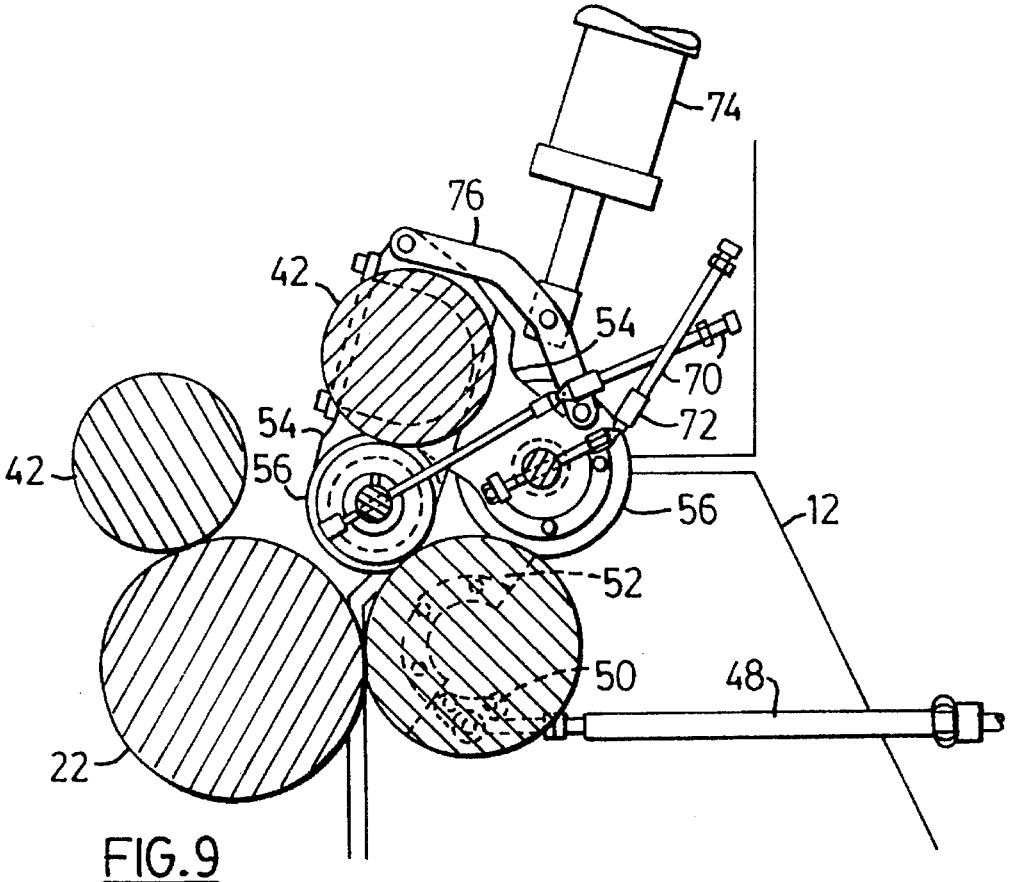
FIG. 9 is a view corresponding to FIG. 8 showing a roll adjustment mechanism.
Figure 10:
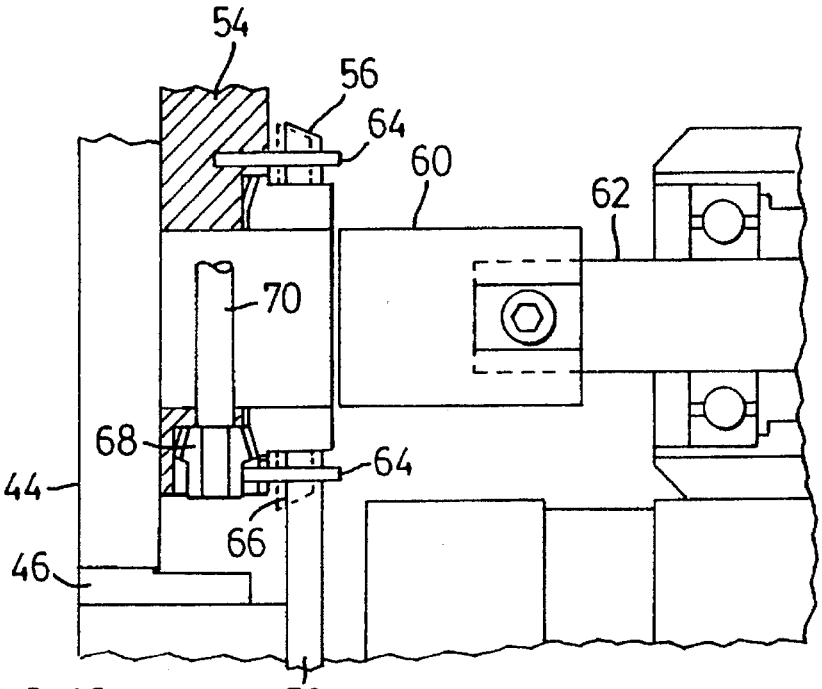
FIG. 10 is a fragmentary actual cross section showing an end portion of a form roller and adjacent portions of a plate cylinder.

A mechanism utilized to achieve this objective is shown in FIGS. 8, 9 and 10.

The plate cylinder 14 is mounted in the cassette 12 by means of a shaft supported at one end by a fixed stud (not shown) and at the other end by a stud mounted in one side wall 44 of the cassette by means of an eccentric bearing housing 46 which may be rotated through a small arc by a screw adjuster 48 acting on a bracket 50 attached to the housing. A disk 52 (in practice a part disk may be used as shown since only a portion of its periphery is utilized), is mounted exactly concentric with the plate cylinder 14, this disk having a diameter which is tapered in the axial direction. The adjuster 48 is utilized to adjust the skew of the plate cylinder by rotating the housing 46, and this adjustment will be reflected in the positioning of the disk 52.

Each of the form rollers is supported at each end by roller hangers 54 pivoted for movement about the axis of a position roller 42 mounted behind its associated form roller or rollers. Each form roller is associated with an accurately concentric annular disk having an internal thread engaged with an external thread of a sleeve 58 rotatable on a stud 60 supporting an end of a form roller shaft 62. The disks 56 have an opposite axial taper on their periphery from the disk 52, and engage the perimeter of the latter. Like the disk 52, the disks 56 have a mean external diameter equal to that of the roller with which they are associated. The disks 56 are restrained from rotation relative to the associated hanger 54 by pins 64 projecting from the hanger through apertures near the periphery of the disks. The sleeve 58 has a bevel gear 66 at one end engaged by a further bevel gear 68 at the end of an actuating shaft 70 which may include an universal joint 72 to accommodate movements of the associated form roller 22. Air cylinders 74 act on the hangers 54 to press the form rollers towards the plate cylinder, in the example shown through a rocking lever 76, and can also be activated to withdraw the form rollers from engagement with the plate cylinder during interchange of cassettes.

Rotation of a shaft 70 in turn rotates the sleeve 58 of the associated form roller 22. Since the associated disk 56 is restrained from rotation by the pins 64, it is moved axially relative to the disk 52, thus controlling the relative positions of that roller and the plate cylinder at their ends bearing the disks. Accordingly, the profile of the flat between the rubber covering of the form roller and the plate roll can be controlled individually for each form roller. For convenience in illustration, the disks, hangers, cylinders and adjusting mechanisms for two form rollers only have been illustrated, but those of the third form roller will be similar except for the absence of a rocking lever 76.

Since the disks 56 are always concentric with the form rollers 22 and the disk 52 is always concentric with the plate cylinder, the form roller flats once adjusted are maintained as the plate cylinder skew is adjusted using the adjuster 48, and even as cassettes with plate cylinders of different circumferences are installed, it being understood that the plate cylinder in each cassette will have an associated disk 52 of appropriate diameter accurately concentric with the cylinder.

I claim:

1. A web offset rotary printing machine having a printing tower with upper and lower portions defining therebetween a recess, and an interchangeable cassette housing in the recess and supporting at least plate and blanket cylinders, wherein the upper and lower portions are joined by an elevator mechanism whereby the upper portion may be raised and lowered relative to the lower portion to accommodate the interchange of cassettes of different heights, wherein at least one portion of the tower contains an inker comprising multiple form rollers engageable with a plate cylinder in the cassette, wherein the cassette includes an eccentric support for one end of the plate cylinder, and at least a part disk accurately concentric with the cylinder, wherein the form rollers are supported by pivoting hangers from the tower portion for movement into engagement with the plate cylinder and each has a concentric disk at its one end with a periphery engageable with the periphery of the disk associated with the cylinder, the peripheries of the disks being axially tapered, the taper on the disk associated with the cylinder being opposite to that of the disks associated with the form rollers, and each disk associated with a form roller being provided with a mechanism for adjusting its axial position whereby to adjust a contact area between that roller and the plate cylinder.

2. A printing machine according to claim 1, wherein each disk associated with a form roller is restrained against rotation relative to a hanger supporting the one end of that roll, and has an internal thread which is supported concentrically with the roller on an externally threaded sleeve supported for rotation on the hanger.

3. In a web offset rotary printing machine comprising a plate cylinder and plurality of form rollers engageable with the cylinder for transferring ink thereto, wherein the machine includes an eccentric support for one end of the plate cylinder, and at least a part disk accurately concentric with the cylinder, wherein the form rollers are supported by pivoting hangers from the machine for movement into engagement with the plate cylinder and each has a concentric disk at its one end with a periphery engageable with the periphery of the disk associated with the cylinder, the peripheries of the disks being axially tapered, the taper on the disk associated with the cylinder being opposite to that of the disks associated with the form rollers, and each disk associated with a form roller being provided with a mechanism for adjusting its axial position whereby to adjust a contact area between that roller and the plate cylinder.

* * * * *